US007587777B2

(12) United States Patent
Ogburn

(10) Patent No.: US 7,587,777 B2
(45) Date of Patent: Sep. 15, 2009

(54) MULTIPURPOSE TOOL FOR REMOVING GUM AND THE LIKE FROM MULTI-SURFACES

(76) Inventor: John D. Ogburn, 1048 Torngat Ct., Virginia Beach, VA (US) 23454

( * ) Notice: Subject to any disclaimer, the term of this patent is extended or adjusted under 35 U.S.C. 154(b) by 0 days.

(21) Appl. No.: 11/895,081

(22) Filed: Aug. 24, 2007

(65) Prior Publication Data

US 2009/0049629 A1 Feb. 26, 2009

(51) Int. Cl.
*B25B 13/00* (2006.01)

(52) U.S. Cl. ..... 7/138; 15/236.08

(58) Field of Classification Search ..... 7/138, 7/142, 158, 105, 103; 15/105, 236.08
See application file for complete search history.

(56) References Cited

U.S. PATENT DOCUMENTS

| | | | | | |
|---|---|---|---|---|---|
| 597,345 | A * | 1/1898 | Welsh | 7/154 |
| 1,096,496 | A | 5/1914 | Dysko | |
| 1,490,766 | A | 4/1924 | Camden | |
| 2,148,944 | A | 2/1939 | Helm | |
| 2,575,779 | A * | 11/1951 | Young | 7/138 |
| 2,806,240 | A | 9/1957 | Cottar | |
| 3,138,867 | A * | 6/1964 | Harrison | 30/123 |
| 4,122,569 | A * | 10/1978 | Hitchcock | 7/134 |
| 4,620,369 | A * | 11/1986 | Gercken | 30/329 |
| 4,924,544 | A * | 5/1990 | Culotta | 7/138 |
| 4,945,638 | A * | 8/1990 | Dietel | 30/309 |
| 5,251,352 | A * | 10/1993 | Cullison | 7/105 |
| 5,309,598 | A | 5/1994 | Carpenter | |
| 5,694,660 | A * | 12/1997 | Rachwalski | 15/237 |
| 6,112,364 | A * | 9/2000 | Myers | 15/236.08 |
| 6,311,362 | B1 | 11/2001 | Arbogast | |
| 2002/0189036 | A1 | 12/2002 | Thomas | |
| 2005/0028311 | A1 | 2/2005 | Birnbaum | |
| 2007/0277336 | A1 * | 12/2007 | Heaslet | 15/105 |

* cited by examiner

*Primary Examiner*—D. S Meislin
(74) *Attorney, Agent, or Firm*—William G. Sykes

(57) ABSTRACT

A multipurpose multi-surface scraping tool to facilitate removing gum, grease, wax, and other such materials from the surface of carpet, grout, tile, concrete and the like. The tool has an ergonomically correct, lightweight handle with a replaceable scraper blade removably attached thereto. The handle may be formed from aluminum, plastic, or another lightweight material. The scraper blade is typically formed from stainless steel or another, wear resistant material and has scrapping teeth disposed on an outer edge thereof. The scraper blade is removable from the handle to allow re-sharpening or replacing. The opposite end of the handle structure is configured as a wrench for loosening and tightening jets on a carpet cleaning wand. The wrench may be an open end or box configuration. The combination of the scraping and wrench functions allows an operator to carry only one tool to perform frequently required operations in the course of cleaning a carpet.

10 Claims, 4 Drawing Sheets

MULTIPURPOSE TOOL FOR REMOVING GUM AND THE LIKE FROM MULTI-SURFACES

FIELD OF THE INVENTION

The invention pertains to gum removal tools and, more particularly, to a multipurpose tool having a scraper with an interchangeable tip and a wrench for tightening jets of a carpet cleaning wand.

BACKGROUND OF THE INVENTION

Removing chewing gum, grease, paint, candle wax, caulking, tar, food, and other such items from both hard and soft surfaces, such as carpets, tile, grout, concrete, upholstery and the like has been a long-standing problem. Such substances are typically sticky and easily get embedded in the upper portion, or the nap of the carpet. Fortunately, however, such substances usually penetrate neither the primary backing to which the nap is woven or stitched, nor the secondary backing that is typically glued to the lower surface of such primary backing against the floor.

Various devices have been used in the past to remove such substances from carpet. One such device designed primarily for removing gum from carpet is a so-called "bone scraper", which is an elongated, flattened device about the size and shape of a Popsicle stick. The bone scraper is typically slightly shorter in length than its width, the width thereof being tapered at one end to a point. The device is typically used in conjunction with a gum-dissolving solvent that is worked into the gum by means of the pointed end of the scraper. This action allows the solvent to mix with the gum. The solvent prevents the gum from further sticking to itself, the carpet, and the scraper. Consequently, the gum may be picked from the carpet in pieces. This avoids the necessity of completely dissolving the gum. However, such bone scraper devices are only marginally effective in removing gum from carpets.

An appropriate gel-type solvent can be used on the gum, grease, paint, or wax, etc., rather than the typical non-thickened solvents that have a water-like consistency. Such gels do not soak through the nap into the primary backing, which could otherwise dissolve the glue laminating the primary to the secondary backing. For example, glues which are latex-based dissolve and the glue, thus, delaminate the carpet. One such gel-type solvent for use with gum is a citrus peel-based solvent with a thixotropic thickening agent.

Even in combination with an appropriate solvent, no scraping device of the prior art has proven effective in removing gum, wax, etc. from carpets.

One problem encountered when using scrapers of the prior art for removing gum or the like from a carpet is that while seemingly soft, carpets quickly wear tools dragged across the surface thereof and hard surfaces such as concrete and tile will immediately ruin the tools. This is particularly true of lightweight tools formed from plastic. Even metal tools formed from aluminum or other soft metals quickly wear. Making a tool from a hard, wear-resistant material adds excessive weight and cost to the tool. It would be desirable, therefore, to create a scraping tool from a low-cost, lightweight material and equip the tool with a replaceable blade portion formed from an appropriately hard material.

Another problem facing commercial carpet cleaners is that jets on the wand become blocked frequently while cleaning carpet. This necessitates the removal, cleaning and re-installation of the jets. Typically, a tool, for example, a wrench, must be used to remove and reinstall the jets. This requires the operator of the cleaning machine to carry yet another tool. It would, therefore, be desirable to combine a wrench function with another frequently used tool already being carried by the operator.

DISCUSSION OF THE RELATED ART

U.S. Pat. No. 1,490,766 for TOOL FOR TREATING RAZOR STROPS, issued Apr. 15, 1924 to A. B. Camden, provides a hand-held tool having a handle portion and a flattened lower face with serrated teeth. The rounded handle portion may be used to smooth a leather strop.

U.S. Pat. No. 2,148,944 for FISH-SCALING TOOL, issued Feb. 28, 1939 to John T. Helm, discloses a curved blade having serrated teeth and an outer edge useful for scaling fish.

U.S. Pat. No. 2,806,240 for ADHESIVE SPREADER, issued Sep. 17, 1957 to Robert Cottar, shows a tool with the serrated edge raised slightly above a support structure to spread a uniform, patterned layer of adhesive on a surface.

U.S. Pat. No. 6,311,362 for SCRAPER FOR REMOVING CHEWING GUM, GREASE, PAINT, AND WAX FROM CARPET, issued Nov. 6, 2001 to Gary W. Arbogast, discloses a curved, hand-held tool made of plastic having scraping teeth on a lower surface thereof.

None of the patents and published patent applications, taken singly, or in any combination are seen to teach or suggest the novel multipurpose tool of the present invention.

SUMMARY OF THE INVENTION

In accordance with the present invention, there is provided a multipurpose multi-surface scraping tool to facilitate removing gum, grease, wax, and other such materials from the surface of carpet, tile, grout, concrete and the like. An ergonomically correct, lightweight handle has a replaceable scraper portion removably attached thereto. The handle may be formed from aluminum, plastic, or another lightweight material. The scraper portion is typically formed from stainless steel or another wear-resistant material. The opposite end of the handle structure is configured as a wrench for loosening and tightening jets on a carpet cleaning wand. The combination of the scraping and wrench functions allows an operator to carry only one tool to perform two frequently required operations in the course of cleaning carpet, tile, grout, concrete and the like.

It is, therefore, an object of the invention to provide a combination multi-surface scraper and wrench.

It is another object of the invention to provide a combination of multi-surface scraper and wrench having a removable scraper portion so it can be re-sharpened or replaced.

It is an additional object of the invention to provide a combination multi-surface scraper and wrench having an ergonomically correct, lightweight handle.

It is a further object of the invention to provide a combination multi-surface scraper and wrench having a removable scraper portion formed from a hardened material, for example, stainless steel.

It is a still further object of the invention to provide a combination multi-surface scraper and wrench, wherein the wrench portion is sized and adapted to loosen and tighten the jets of a carpet cleaning wand.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a combination multi-surface scraping tool and wrench useful for both scraping gum, grease, candle wax, tar, caulking, food, or other similar materials from both hard and soft surfaces such as carpeting, upholstery, tile, grout, concrete and the like as well as for loosening and tightening jets of a carpet cleaning wand.

Figure 1A:
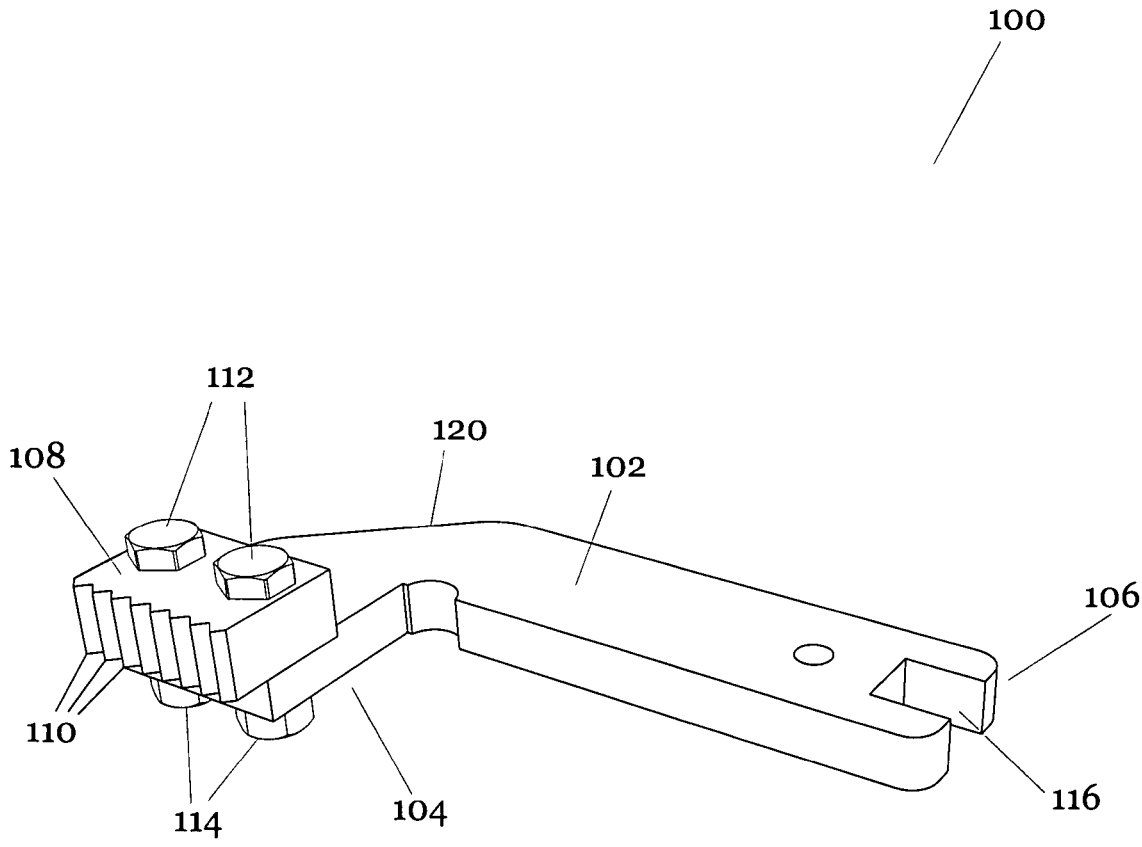
FIG. 1*a* is a perspective view of the combination tool of the present invention.
Figure 1B:
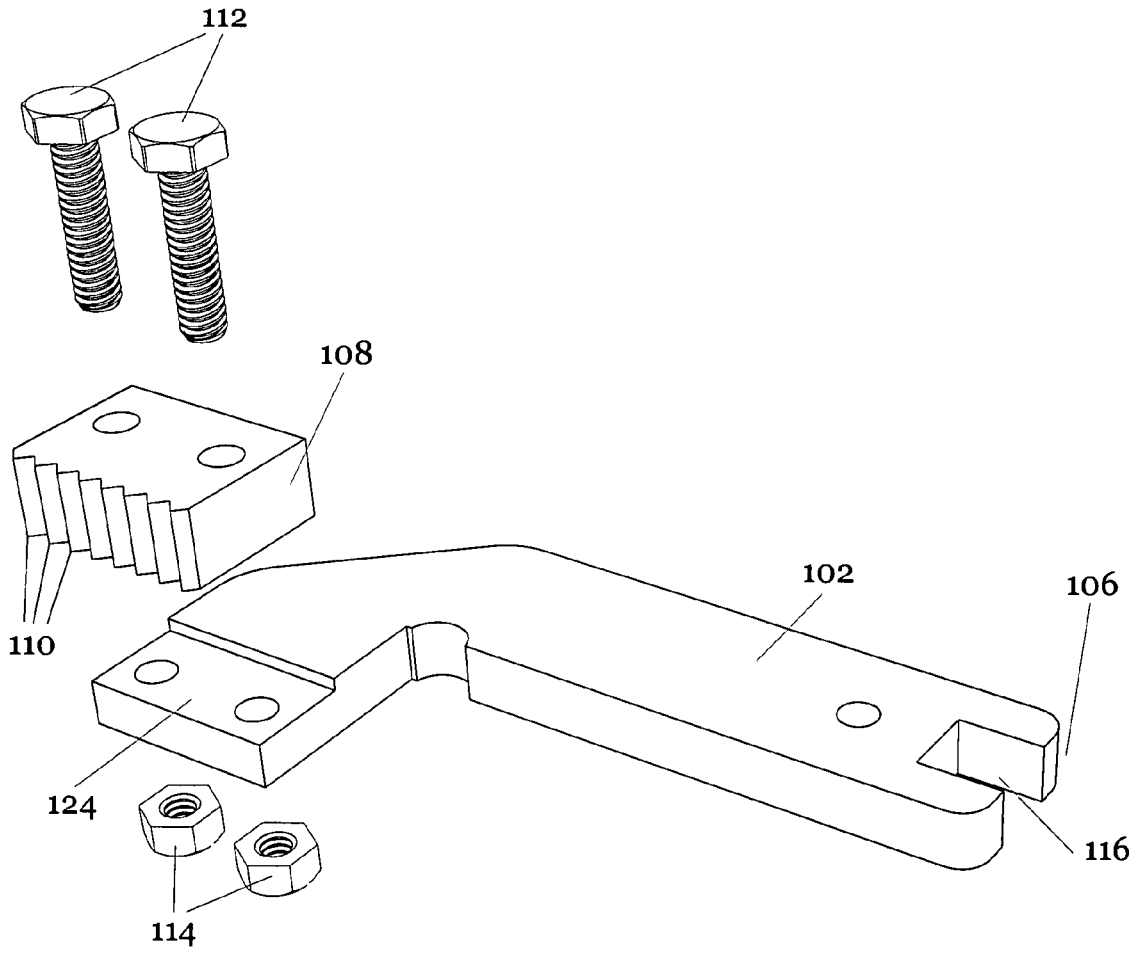
FIG. 1*b* is an exploded, perspective view of the tool of FIG. 1*a;*

Referring first to FIGS. 1*a* and 1*b*, there are shown perspective and exploded, perspective views, respectively, of the combination tool of the present invention, generally at reference number 100. A body 102 has a proximal end 104 and a distal end 106. Proximal end 104 is substantially perpendicular to distal end 106.

Body 102 is formed from aluminum in the embodiment chosen for purposes of disclosure. However, it will be recognized that body 102 may be formed from a polymer, another metal, or any other suitable durable material.

Body 102 may be shaped using any suitable technology. For example, body 102 may be injection molded from a polymeric material or machined from a metallic material. As tool 100 may be used on hard surfaces such as concrete, it is important that the material from which body 102 is formed have the necessary strength to allow a "hammering" action to be performed. A user often hits, taps, or otherwise forcefully applies tool 100 against the substance being removed from a surface. In addition, the hardness of scraping blade 108 must be sufficient to provide adequate wear even when tool 100 is used on concrete or another hard surface.

Body 102 has a recessed portion 124 adapted to receive and position the scraping blade 108.

A scraping blade 108 has serrated teeth 110 disposed on an outward-facing edge thereof. Scraping blade 108 is removably attached to body 102 at its distal end 104. Scraping blade 108 is typically formed from a hardened material, for example, stainless steel.

In the embodiment chosen for purposes of disclosure, bolts 112 and nuts 114 are used to secure scraping blade 114 to body 102. It will be recognized that alternative attachment mechanisms may be provided. In alternate embodiments, a quick-connect connection device could be substituted for bolts 112 and nuts 114. Such mechanisms are believed to be well known to those of skill in the art. Consequently, quick-connect mechanisms are not further described herein.

An opening 116 in the distal end 106 of body 102 is sized and configured to form an open-end wrench to properly accommodate jets on a carpet cleaning wand, not shown. In the embodiment chosen for purposes of disclosure, opening 116 forms a ½ inch wrench suitable for loosening and tightening the high pressure jets on a typical cleaning wand of a carpet cleaning machine. While an open end wrench configuration has been chosen for purposes of disclosure, it will be recognized that other wrench configurations could readily be formed in distal end 106 of body 102. For example, a box wrench having a hexagonal or other multifaceted configuration could be formed in distal end 106 of body 102. Consequently, the invention is not considered limited to a particular wrench size or configuration. Rather, the invention includes any and all suitable wrench configurations and sizes, adaptable to accommodate a spray jet of the carpet cleaning wand.

It will be recognized that while it is assumed that spray jets in carpet cleaning wands are of a single size, multiple wrenches could be formed proximate distal end 106 of the body 102 to accommodate multiple sizes of spray jets, if desired. In still other embodiments, wrenches sized for tasks other than loosening and tightening spray jets could, likewise, be included in combination tool 100.

Figure 2:
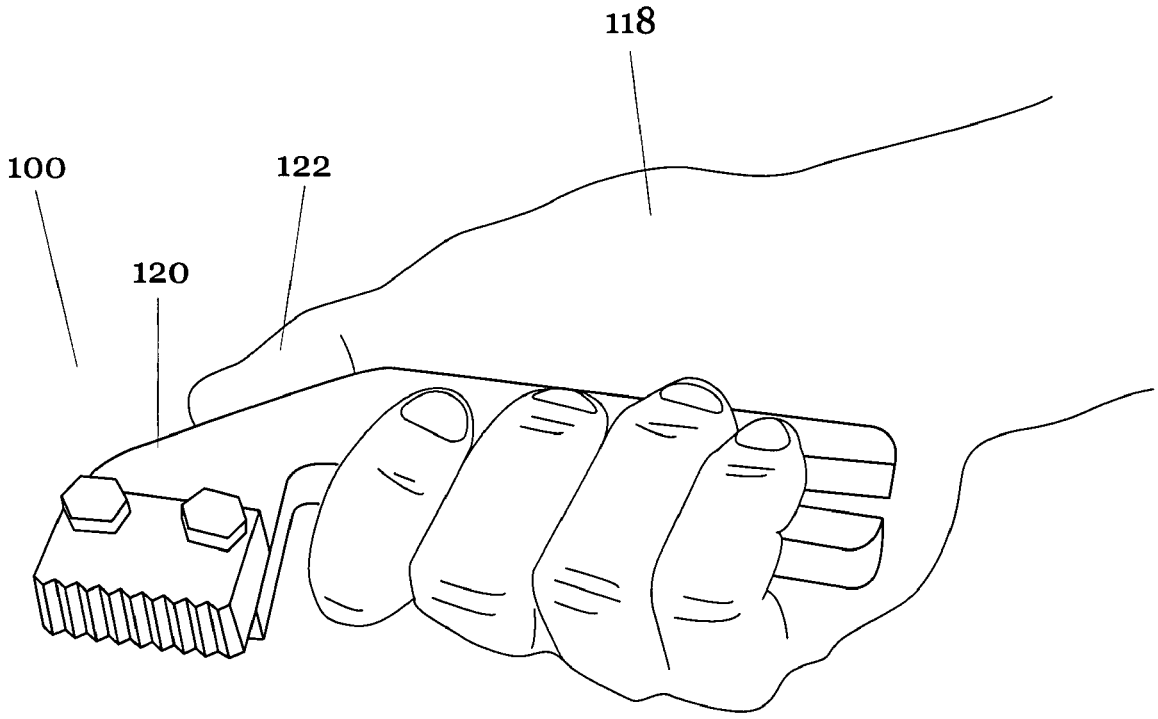
FIG. 2 is a perspective view of the combination tool of FIG. 1 grasped in the hand of a user.
Figure 3:
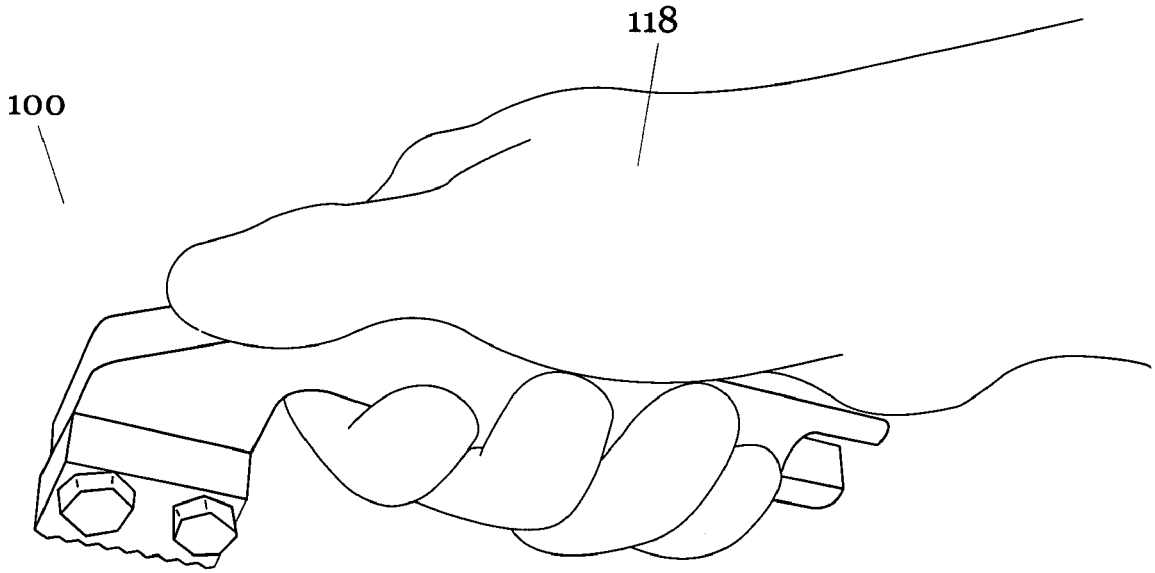
FIG. 3 is a perspective view of the combination tool depicted in FIGS. 1*a* and 1*b*, shown in its intended working orientation and in the hand of a user.

Referring now to FIGS. 2 and 3, there are shown perspective views of combination tool 100 in the hand 118 of a user. An angled portion 120 of body 102 provides a surface upon which a thumb 122 of hand 118 may be rested or upon which pressure may be exerted when using combination tool 100. The shape of body 102 is specifically designed to allow a user to exert a maximized pressure against the substance being loosened.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A combination multi-surface scraping and wrench tool, comprising:

a) a solid, planar, elongated body having a predetermined thickness, comprising:

i) a first handle portion having a first predetermined length, and a constant width, and a proximal end, a substantial portion of said first handle portion being devoid of projections and indentations; and ii) a second portion comprising a second predetermined length and a distal end, said first handle portion and said second portion being disposed substantially perpendicular to and coplanar with one another, said first length being greater than said second length;

b) a blade-receiving region disposed proximate said distal end of said second portion and having a thickness less than a remaining portion of said planar, elongated body, said blade receiving portion defining an abutment;

c) a single scraping blade removably attached to said blade receiving portion of said planar, elongated body adjacent said abutment, said scraping blade having a thickness greater than said thickness of said planar, elongated body d) a plurality of scraping teeth disposed on an outward facing surface of said scraping blade substantially parallel to a major axis of said first portion of said planar, elongated body; and e) a wrench disposed in said proximal end of said first handle portion of said body.

2. The combination multi-surface scraping and wrench tool as recited in claim 1, further comprising:

f) means for attaching, operatively connected to said body and said scraping blade.

3. The combination multi-surface scraping and wrench tool as recited in claim 2, wherein said means for attaching comprises at least one bolt through said body of said scraping blade, and at least one nut threadably affixed to said bolt.

4. The combination multi-surface scraping and wrench tool as recited in claim 3, wherein said at least one bolt comprises two bolts, each having a nut threadably affixed thereto.

5. The combination multi-surface scraping and wrench tool as recited in claim 1, wherein said scraping blade comprises a material different from the material of said body.

6. The combination multi-surface scraping and wrench tool as recited in claim 5, wherein said scraping blade comprises stainless steel.

7. The combination multi-surface scraping and wrench tool as recited in claim 5, wherein said body comprises at least one material selected from the group: aluminum, and a polymer.

8. The combination multi-surface scraping and wrench tool as recited in claim 1, wherein said wrench comprises an open end wrench.

9. The combination multi-surface scraping and wrench tool as recited in claim 8, wherein said open end wrench is sized and configured to accommodate a spray jet of a carpet cleaning machine.

10. The combination multi-surface scraping and wrench tool as recited in claim 8, wherein said wrench is a ½ inch wrench.

* * * * *